United States Patent [19]

Craven

[11] 4,108,312

[45] Aug. 22, 1978

[54] HANGER FOR RACQUETS

[76] Inventor: Charles G. Craven, 35 Will Dr., Canton, Mass. 02021

[21] Appl. No.: 701,163

[22] Filed: Jun. 30, 1976

[51] Int. Cl.[2] ..... A47F 7/00

[52] U.S. Cl. ..... 211/13; 211/89

[58] Field of Search ..... 211/13, 14, 40, 41, 211/86, 87, 88, 89, 120, 175, 49, 65; 273/74; 248/117.1, 117.2, 117.4, 117.6, 117.7, 451, 453, 448, 16, 274, 288, 291, 298, 305–307, 309, 310, 316 R, 316 A, 201; 312/9, 12, 42, 45, 49; 206/72, 84, 44.12, 45.11, 315

[56] References Cited

U.S. PATENT DOCUMENTS

| | | | |
|---|---|---|---|
| 832,915 | 10/1906 | Lillywhite | 273/74 |
| 1,988,697 | 1/1935 | Morris | 248/117.6 X |
| 2,439,438 | 4/1948 | Thomson | 248/117.7 X |
| 2,454,516 | 11/1948 | Laureyns | 211/41 |
| 2,481,869 | 9/1949 | Pilato | 248/117.7 |
| 2,695,105 | 11/1954 | Mitchell | 211/89 X |
| 2,767,854 | 10/1956 | Barrett | 211/65 X |
| 2,942,830 | 6/1960 | Senay | 248/316 R X |
| 3,964,708 | 6/1976 | Reeves | 211/89 X |

FOREIGN PATENT DOCUMENTS

| | | | |
|---|---|---|---|
| 641,088 | 1/1964 | Belgium | 248/117.6 |
| 1,235,773 | 6/1971 | United Kingdom | 211/87 |

*Primary Examiner*—Roy D. Frazier
*Assistant Examiner*—Terrell P. Lewis

[57] ABSTRACT

A hanger for tennis and like racquets has a back plate attachable to a wall or door and provided with transversely spaced holders having supporting and retaining walls to receive and support the portions of at least one racquet head that curves inwardly towards its handle and thus support the racquet by its head with its handle extending downwardly. The holders are attached to the plate for movement towards and away from each other as required by the width of the racquet or racquet heads to be supported.

4 Claims, 5 Drawing Figures

13
12A
12
12
18
24
25
26
19
20
21
10

11
20
10
22
23
19
21

4
13
12
16
17
15
28
27
24
14
10
11

13
17
18
15
10
14
19
20
26
27
28
11
21
22
23
16
12

10A
11A
20A
20A
25A
25A
26A
26A
28A
24A
24A
21A
21A
19A
19A

HANGER FOR RACQUETS

BACKGROUND OF THE INVENTION

The storage of tennis, squash and badminton racquets usually presents somewhat of a problem if they are to be conveniently accessible and protected from damage and at the same time not take a disproportionate amount of space or be in the way. The present popularity of tennis highlights the storage problem and for that reason, the invention is herein discussed with particular reference to hangers for tennis racquets for use in the home or club house but they of course may be used in stores for display purposes.

While there are tennis racquet holders on the market, none, as far as I am aware, is of a construction meeting the combined requirements of cost, utility and appearance.

THE PRESENT INVENTION

The general objective of the present invention is to provide racquet hangers adapted to meet the above generally indicated requirements, an objective attained with a racquet hanger having a back plate and transversely spaced holders to accommodate and support at least one and preferably two racquet heads with their handles depending and the holders in engagement with portions of the heads that curve inwardly towards their handles. The holders are constructed to support a plurality of racquets with their heads spaced from each other or to be transversely adjustable as required by the width of the racquet heads, and desirably with hangers having both features. When the holders are not to be adjustable, they may be formed as integral parts of the back plate.

Another objective of the invention is to provide hangers with at least the back plate of plastic, an objective attained with a thin-walled plate having a rearwardly disposed margin and with its rear wall having reinforcements including bosses having apertures for use in securing the hangers, desirably of a keyhole shape with the outer surfaces of the narrow portions relieved to accomodate the head of mounting screws.

BRIEF DESCRIPTION OF THE DRAWINGS

The accompanying drawings illustrate preferred embodiments of the invention and

THE PREFERRED EMBODIMENT OF THE INVENTION

Figure 1:
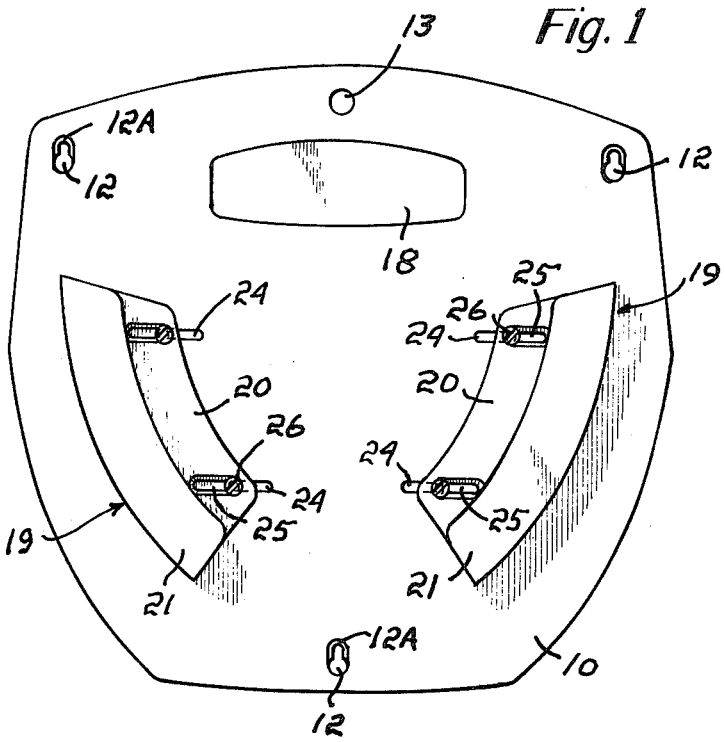
FIG. 1 is a front view of a racquet holder in accordance with one embodiment of the invention.
Figure 2:
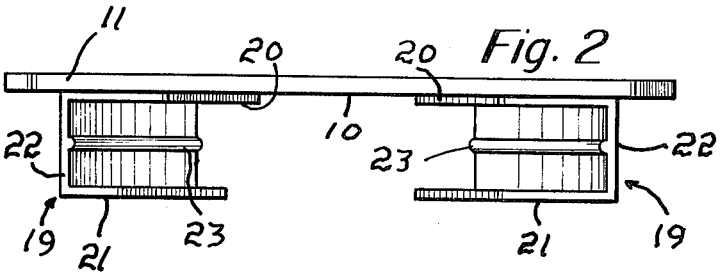
FIG. 2 is a view of the holder as viewed from the upper end thereof.
Figure 3:
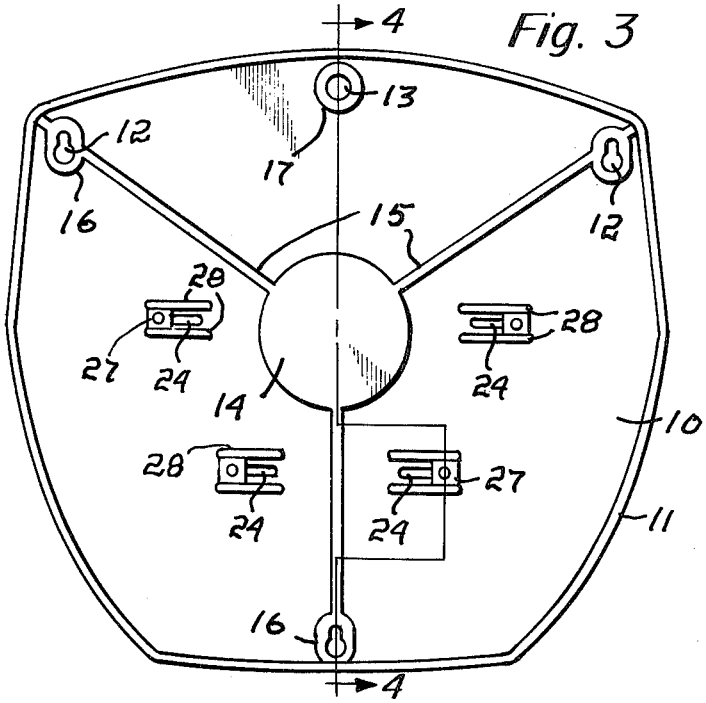
FIG. 3 is a rear view of the holder.
Figure 4:
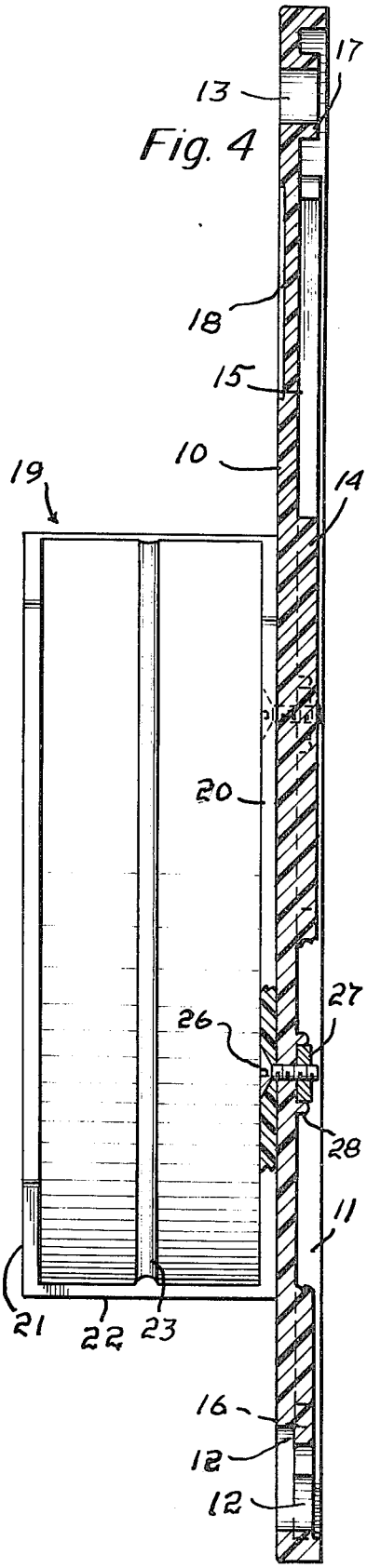
FIG. 4 is a section on a substantial increase in scale and taken approximately along the indicated line 4—4 of FIG. 3.

The racquet hangers illustrated by the drawings have molded back plates to be mounted on a wall or door and transversely spaced arcuate holders dimensioned to receive and support the lower portion of the head of at least one racquet with its handle extending downwardly with the holders attached to the back plates rather than formed integrally therewith.

In the embodiment of the invention illustrated by FIGS. 1–4, the back plate indicated at 10 is of a suitable plastic and is molded with a rearwardly disposed margin 11 and a series of keyhole slots 12, one adjacent each side and the upper edge and one centrally of its bottom edge. In addition there is a hole 13 centrally of its upper edge that may also be used in attaching the hanger.

As the base 10 is relatively thin, its rear surface is formed with a central boss 14 and radiating ribs 15 joining the margin 11 and adjacent thereto each includes a small boss 16 through which the keyhole slots 12 extend thus enabling the smaller ends of the slots 12 to be marginally relieved on the outer face of the plate as at 12A to accommodate the heads of screws, not shown, where such are used to detachably support the hangers. In addition, a small boss 17 is provided through which the hole 14 opens. It will be noted from FIG. 4 that the bosses and ribs lay within the plane defined by the margin 11. Desirably and as shown, the back plate 10 is formed with a shallow recess 18 for a label or name plate.

In the preferred embodiments, the holders are generally indicated at 19 and are molded arcuate channels with their inner walls 20 wider than their outer walls 21 and the joining or supporting wall 22 of a width to enable two racquet heads to be accommodated and with a central rib 23 to space them apart.

As the width of racquet heads varies, the holders 19 are secured to the base plate 10 in a manner enabling their spacing to be adjusted as required by the width of the racquet heads. To that end, the back plate 10 is provided with pairs of vertically spaced slots 24, one pair for each channel member 19. The inner wall 20 of each channel member 19 has a pair of parallel slots 25 spaced and arranged so that each may be in at least partial registry with the appropriate one of the slots 24 thus to enable the holders 19 to be connected to the back plate 10 for movement towards or away from each other with the slots 24 extending transversely of the back plate 10 in a manner such that the holders 19, in any position, have a desired relationship with it. The holders 20 are shown as connected to the back plate 10 by bolts 26 with nuts 27 held against turning by parallel confining ribs 28 molded on the rear face of the plate 10 and terminating slightly below the plane defined by its margin 11. The slots 25 are marginally relieved to accommodate the bolt heads and the width of the walls 20 is such that their kerfs are exposed in any adjusted position of the holders 20 to enable the connections to be tightened or loosened.

Figure 5:
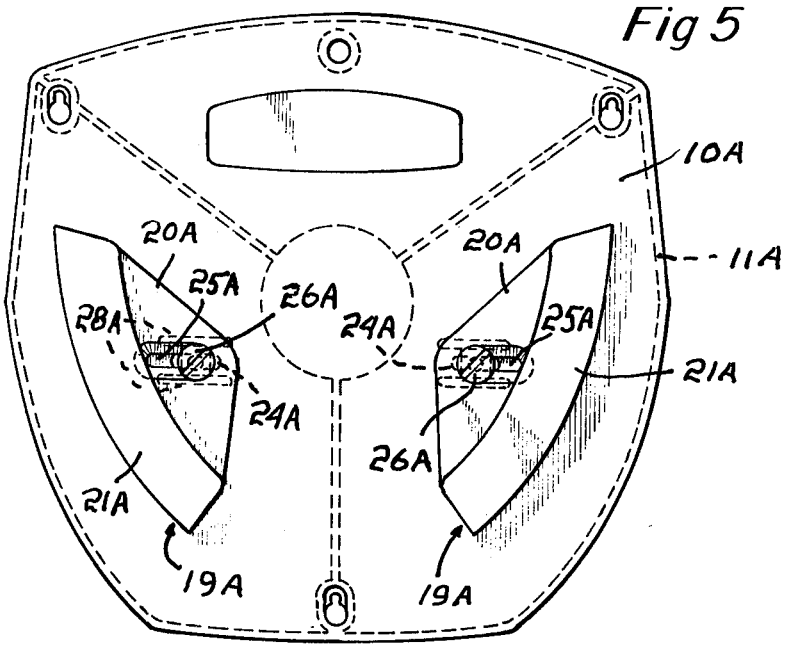
FIG. 5 is a front view of a racquet holder in accordance with another embodiment of the invention.

In FIG. 5, an embodiment of the invention is shown in which the base 10A differs from the base 10 in that it has spaced transversely extending, aligned slots 24A, one for each holder member 19A. Each holder 19A differs from the holder 19 in that its inner wall 20A is of a generally triangular form and has a slot 25A disposed to at least partially register with the appropriate one of the slots 24A in any adjusted position of the holders 19A and each holder 19A is connected to the back plate 10A by a bolt 26A, the nut 27A for which is held against turning by ribs 28A.

Such a holder 19A has the advantage that not only is its position controlled by a connection but also by reason of the fact that it may be turned to conform to the shape of the racquet head engaged thereby.

I claim:

1. A hanger for a plurality of racquets, said hanger comprising a back plate attachable to a door or wall and a pair of holders transversely spaced on said back plate to receive between them depending racquet handles, each holder including a supporting wall and inner and outer retaining walls parallel to the plate and disposed towards the opposite holder, the outer retaining wall spaced from the plate a distance such that said heads are freely received and loosely held by and between said holders, the supporting wall of each holder shaped to be engaged by a major portion of the head of a racquet that curves inwardly from the zone of maximum width towards its handle and the outer wall dimensioned to overlie the margins of the head throughout at least a major part of said portion, and means connecting the inner wall of each holder to the back plate with the inner wall seated thereagainst, said connecting means of each holder including a vertically spaced pair of parallel horizontally slidable connections, to enable the holders to be slid towards and away from each other between predetermined proximate and remote spaced apart relationships as required for the accommodation of racquet heads within a predetermined width range.

2. The racquet holder of claim 1 in which the connecting means also enables each holder to be pivoted thus to enable the spacing between either of their ends to be adjusted independently of the other ends thereof.

3. The racquet holder of claim 1 in which the connecting means of each holder includes a single transversely slidable connection that also includes a pivot.

4. The racquet holder of claim 1 in which the supporting wall of each holder includes a lengthwise rib on its interior surface spaced to separate adjacent racquet heads and engageable thereby only when entered in said holder and substantially in their supported position, said rib of a height substantially less than the width of the retaining wall.

* * * * *